US006189816B1

(12) United States Patent
Stier

(10) Patent No.: US 6,189,816 B1
(45) Date of Patent: Feb. 20, 2001

(54) METHOD FOR PRODUCING A VALVE-SEAT BODY FOR A FUEL INJECTION VALVE, AND CORRESPONDING FUEL INJECTION VALVE

(75) Inventor: Hubert Stier, Asperg (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/367,802

(22) PCT Filed: Oct. 2, 1998

(86) PCT No.: PCT/DE98/02928

§ 371 Date: Aug. 19, 1999

§ 102(e) Date: Aug. 19, 1999

(87) PCT Pub. No.: WO99/32259

PCT Pub. Date: Jul. 1, 1999

(30) Foreign Application Priority Data

Dec. 20, 1997 (DE) ..... 197 57 117

(51) Int. Cl.[7] ..... F02M 59/00

(52) U.S. Cl. ..... 239/533.2; 239/900; 29/888.44; 29/890.122; 29/890.132

(58) Field of Search ..... 239/533.2, 585.1, 239/585.4, 584, 900; 251/333, 129.21; 137/359; 29/888.44, 890.122, 890.132

(56) References Cited

U.S. PATENT DOCUMENTS

| | | | | |
|---|---|---|---|---|
| 3,191,277 | * | 6/1965 | Glasgow | 29/888.44 |
| 5,285,968 | | 2/1994 | Greiner et al. . | |
| 5,785,254 | * | 7/1998 | Zimmerman et al. | 239/900 |

FOREIGN PATENT DOCUMENTS

| | | |
|---|---|---|
| 40 37 952 | 6/1992 | (DE) . |
| 44 18 228 | 9/1995 | (DE) . |
| 195 37 382 | 4/1997 | (DE) . |
| 196 02 068 | 7/1997 | (DE) . |
| 9-068134 | 3/1997 | (JP) . |

* cited by examiner

*Primary Examiner*—Andres Kashnikow
*Assistant Examiner*—Lisa Ann Douglas
(74) *Attorney, Agent, or Firm*—Kenyon & Kenyon

(57) ABSTRACT

Besides the conventional process steps of manufacturing a valve-seat body, forming a through opening inside the valve-seat body, forming a valve-seat as a frustoconical section of the through opening, and forming a guide area, the proposed method for manufacturing a valve seat for a fuel injector includes the simultaneous fine-machining of all guide sections in the guide area and the valve-seat area using a master ball.

10 Claims, 2 Drawing Sheets

METHOD FOR PRODUCING A VALVE-SEAT BODY FOR A FUEL INJECTION VALVE, AND CORRESPONDING FUEL INJECTION VALVE

BACKGROUND INFORMATION

1. Field of the Invention

The present invention is based on a method for manufacturing a valve-seat body having a valve seat for a fuel injector and for manufacturing a fuel injector.

2. Background Information

German Application No. 40 37 952 already describes a fuel injector having a valve-seat body which, inter alia, has a guide bore and a valve seat. The guide bore serves for guiding an axially movable valve needle which is provided with a valve-closure member designed as a ball. This ball co-operates with the valve seat which tapers frustoconically in the downstream direction, forming a sealing-seat valve with it. In the guide bore located upstream of the valve seat, guide sections and fuel ducts alternate over the circumference of the guide bore. In the case of a conventional valve-seat body of this kind, both the guide sections and the valve seat are reworked upon reforming (massive forming, turning). In this context, the guide sections are machined separately from the machining of the valve seat in terms of time and tools by relatively inaccurate internal cylindrical grinding. In internal cylindrical grinding, an abrasive pencil is introduced into the guide bore and used for machining the guide sections in a rotational movement. The valve seat is also fine-machined by grinding, additional reworking by honing being necessary depending on the requirements. To achieve a high rotational accuracy combined with an optimum sealing behavior, several machining tools and sequential fine-machining steps are necessary.

Known from, for example, German Application No. 196 02 068, is a method for manufacturing rotationally symmetric valve-seat faces having a high surface finish at valves, in which method the valve seat is reworked as described above using a spherical tool body. In this context, the spherical tool body is designed with a diameter which is smaller than the cross-section of the guide opening in the valve-seat body to be machined so that only the immediate valve-seat face is fine-machined. The clearance of the guide opening must inevitably be greater than the diameter of the spherical tool since the tool could otherwise not immerse through the, in an axial direction, relatively long guide opening up the valve-seat face in the valve-seat body at all. Furthermore, there is such a great cutting volume for fine-machining in such a cylindrical guide opening that it is impossible to use a spherical tool body for the guide area.

Furthermore, German Patent Application No. 195 37 382 already describes a fuel injector which has a valve-seat body as well as a disk-shaped guide body lying upstream thereof. In this context, the guide body has an at least partially dome-shaped internal guide opening for a spherical valve member. The valve-seat body and the guide body are fine-machined, in each case, separately of each other at their internal openings to be made accurately. This is also carried out using different machining tools in different chucks.

SUMMARY OF THE INVENTION

The method according to the present invention for manufacturing a valve-seat body having a valve seat for a fuel injector has the advantage that, both guide sections and a valve-seat area in a valve-seat body are fine-machined most accurately in a simple fashion requiring little outlay of material, time, and tools. In this context, it is particularly advantageous that only one single machining tool, namely a very accurately formed "master ball", is required for the fine-machining of the different areas, which, besides, is carried out simultaneously in an ideal manner.

It is particularly advantageous to fine-machine the guide sections and the valve seat by ball honing, or ball precision grinding or ball lapping. Using these processes, it is possible to remove minimal quantities of material at the desired locations in the valve-seat body so that, compared to known grinding methods, there are only very small cutting volumes resulting from the, in terms of the surface area, very small guide sections.

Using this machining technology, desired minimal curvatures are produced at the guide sections which have a radius which corresponds to the radius of the master ball. The guide sections, from the start, are advantageously formed narrow in the axial direction and in the circumferential direction, and have therefore a small surface area so that they can be accurately machined in an optimum fashion using the master ball. Thus, rotational accuracies are achieved in an advantageous fashion, which cannot be achieved in the case of conventional ball/conical sealing-seat arrangements with a comparably small outlay.

The fuel injector according to the present invention has the advantage that a valve-seat body having a valve-seat area and a guide area can be fine-machined in a particular simple and cost-effective manner, and, moreover, in an extremely high quality with regard to rotational accuracy and tightness. For that, the guide sections, from the start, are advantageously formed narrow in the axial direction and in the circumferential direction, and have therefore a small surface area so that they can be accurately machined in an optimum fashion using the master ball as machining tool.

DETAILED DESCRIPTION

Figure 1:
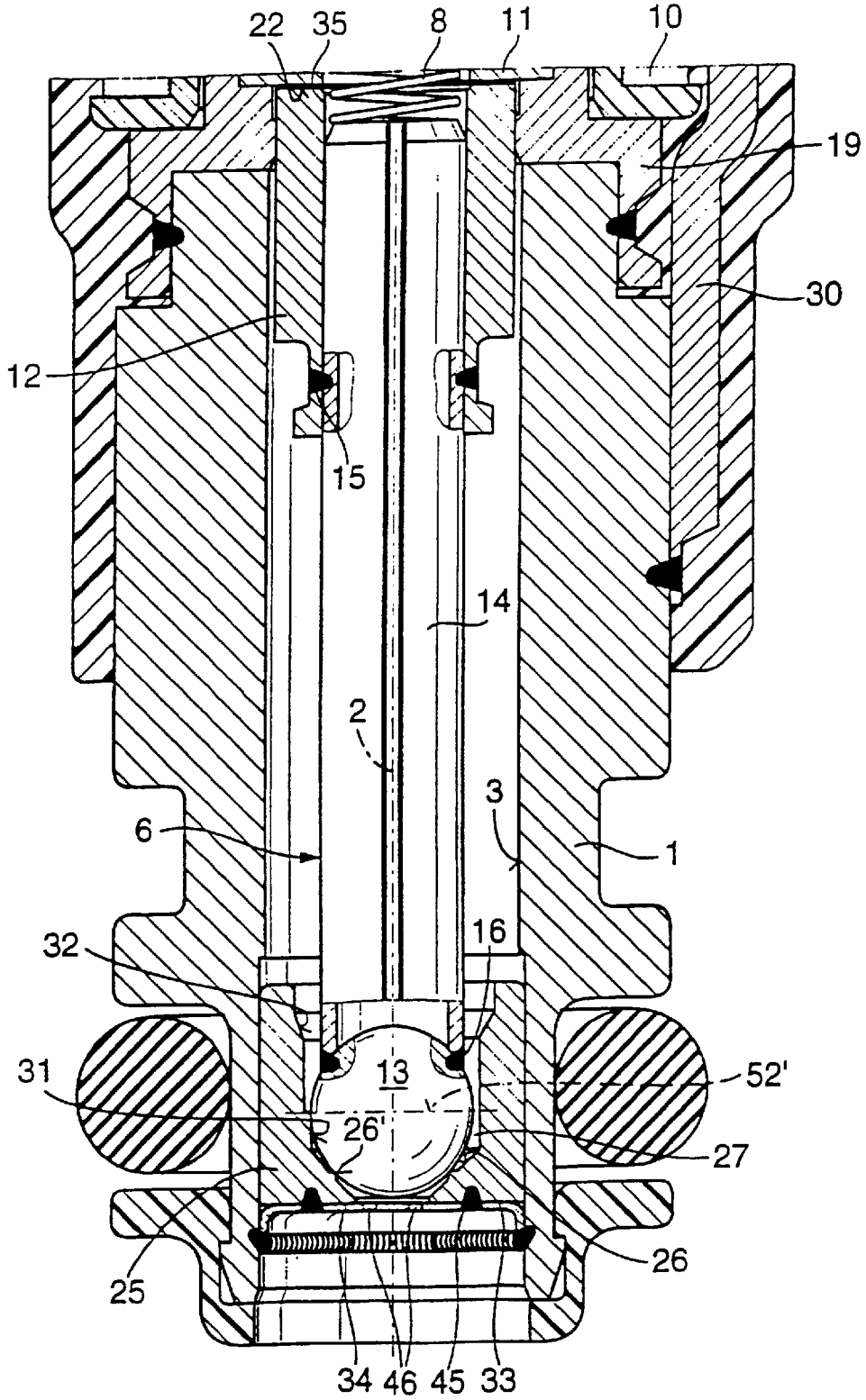
FIG. 1 shows a fuel injector having a specially formed valve seat which is manufactured according to the present invention.

As an exemplary embodiment, an electromagnetically operated valve in the form of a fuel injector for fuel-injection systems of mixture-compressing internal combustion engines with externally supplied ignition is partially depicted in FIG. 1. The valve has a tubular valve-seat body 1, in which a longitudinal borehole 3 is formed concentrically to a longitudinal valve axis 2. An axially movable valve needle 6 is arranged in longitudinal borehole 3.

The electromagnetic operation of the valve is carried out in a conventional manner. For axially moving valve needle 6 and, consequently, opening the valve against the spring resistance of a return spring 8, and respectively, closing the valve, an only partially shown electromagnetic circuit including a magnetic coil 10, a core 11, and an armature 12 is used. Valve needle 6 is formed of armature 12, a spherical valve-closure member 13, and a connecting part 14 connecting these two component parts, connecting part 14 having a tubular design. Return spring 8 supports itself against the upper end face of connecting part 14 with its bottom end. Armature 12 is connected to the end of connecting part 14 facing away from valve-closure member 13 via a welded seam 15, and aligned with core 11. On the other hand, valve-closure member 13 too is firmly connected to the end of connecting part 14 facing away from armature 12, for example, via a welded seam 16. Magnetic coil 10 surrounds core 11 which represents the end, enclosed by magnetic coil 10, of a fuel inlet connection which is not further identified, and which serves for supplying the medium to be metered in by the valve, here fuel.

Concentrically to longitudinal valve axis 2, a tubular metal intermediate piece 19 is joined to the bottom end of core 11 and to valve-seat support 1, e.g., by welding, in a sealing fashion. In the downstream end of valve-seat support 1 facing away from core 11, a cylindrical valve-seat body 25 is mounted by welding in a sealing manner in longitudinal borehole 3, which runs concentrically to longitudinal valve axis 2. The valve-seat body 25 designed according to the present invention has a fixed valve-seat area 26 facing core 11.

Magnetic coil 10 is, at least partially surrounded in the circumferential direction by at least one conductive element 30 used as a ferromagnetic element which is designed, for example, as a bracket, and which engages on core 11 with its one end, and on valve-seat support 1 with its other end, and is connected to these by welding, soldering or bonding.

A guide area 31 of a through opening 32 of valve-seat body 25 serves for guiding valve-closure member 13 during the axial movement. Valve-seat area 26 also represents an area of through opening 32 which, for example, immediately adjoins guide area 31 in the downstream direction. At its one bottom end face 33 facing away from valve-closure member 13, valve-seat body 25 is concentrically and firmly connected to a spray-orifice plate 34 having, for example, a pot-shaped design. The connection between valve-seat body 25 and spray-orifice plate 34 is made, for example, by a continuous and tight welded seam 45 which is made, for example, using a laser. By this method of assembly, the risk of an unwanted deformation of spray-orifice plate 34 in the area of its at least one, for example, four spray orifices 46 produced by erosive machining or punching is prevented. In an advantageous manner, spray-orifice plate 34 should be fixed to valve-seat body 25 prior to the fine-machining of valve-seat body 25 which will still be described in more detail in the following.

The insertion depth of the valve-seat part composed of valve-seat body 25 and spray-orifice plate 34 into longitudinal borehole 3 determines, inter alia, the adjustment of the stroke of valve needle 6 since the one end position of valve needle 6 is determined by the engagement of valve-closure member 13 on valve-seat area 26 when magnetic coil 10 is deenergized. The other end position of valve needle 6 is determined, for example, by the engagement of a top end face 22 of armature 12 on a bottom end face 35 of core 11 when the magnetic coil 10 is energized. The travel between these two end positions of valve needle 6 represents the stroke.

The spherical valve-closure member 13 co-operates with the, in the downstream direction, frustoconically tapering surface of valve-seat area 26 of valve-seat body 25. The immediate valve seat can also be formed by a narrow annular seat area 26' which is slightly raised compared to the frustoconically formed surface. In such a case, annular seat area 26' projects from valve-seat area 26 by approximately 50 to 100 $\mu$m. Guide area 31 has a plurality of flow passages 27 allowing the medium to flow in a direction towards valve seat 26, 26' of valve-seat body 25.

Figure 2:
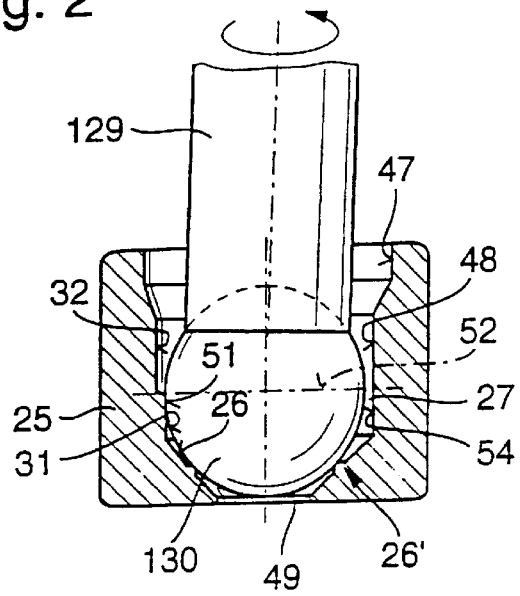
FIG. 2 shows the valve-seat body including a "master ball".

FIG. 2 shows seat body 25 as individual component part together with a "master ball" 130 which is used as a machining tool for fine-machining in the practical application of the manufacturing process according to the present invention. In this context, master ball 130 is attached to, for example, a bar-shaped, rotating tool-holding body 129 which, in a comparable form, is known, for example, from German Application No. 196 02 068. Through opening 32 in valve-seat body 25 has a plurality of differently formed sections or areas which axially adjoin each other. In this context, the essential areas of through opening 32 are an inlet area 47 which tapers in the downstream direction, a middle opening area 48 which has a greater inside diameter than the diameter of spherical valve-closure member 13 or master ball 130 respectively, guide area 31, valve-seat area 26 or annular seat area 26' respectively, as well as an outlet area 49. While areas 47, 48, 26 or 26', and 49 have a uniform design over their circumference, guide area 31 is characterized by a sequence of web-type guide sections 51 and duct-type flow passages 27 alternating over its circumference. This above described contour of the inner through opening 32 as well as the otherwise substantially cylindrical outside contour are produced in known manner by appropriate creative forming and massive forming (e.g., cold working, cold pressing; optionally hardening).

According to the present invention, the final fine-machining of valve-seat area 26 and guide sections 51 in guide area 31 is carried out simultaneously using master ball 130. In this context, the very hard master ball 130, which can be produced very accurately and has an ideal spherical shape, has a slightly greater diameter than valve-closure member 13 which cooperates later with valve seat 26, 26'. The fine-machining of valve-seat body 25 using master ball 130 is a honing (ball honing), or precision grinding, or lapping in which finest-grained honing oils, lapping pastes or grinding pastes are used, making it possible to remove minimal quantities of material at the desired locations in valve-seat body 25. Using this machining technology, desired minimal curvatures are produced at guide sections 51 which have a radius which corresponds to the radius of master ball 130. Guide sections 51, from the start, are advantageously formed very short and narrow in the axial direction and in the circumferential direction, so that they can be accurately machined in an optimum fashion using master ball 130.

Figure 3:
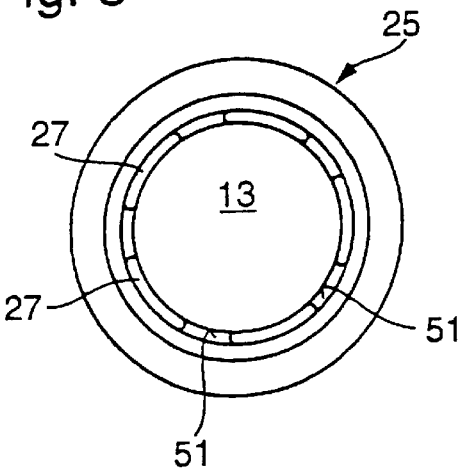
FIG. 3 shows a top view of the valve-seat body including a spherical valve-closure member which is located inside and cooperates with the valve seat.
Figure 4:
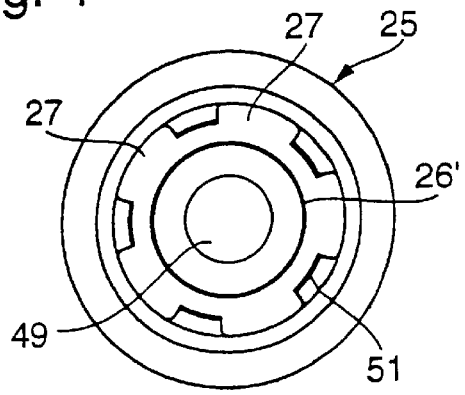
FIG. 4 shows a top view of only the valve-seat body in which the contact spots of the valve-closure member in the valve-seat body are identified not to scale.

In this context, guide sections 51, as viewed in an axial direction, are located in an ideal fashion in the area of ball equator 52, 52' of master ball 130, or respectively, of valve-closure member 13 which will later be arranged there, the guide sections 51 beginning minimally before ball equator 52, 52' following opening area 48 as viewed, for example, in the downstream direction. Ball equator 52' of valve-closure member 13 is indicated in FIG. 1. Guide sections 51, while facing away from valve-seat area 26, 26', extend axially to the extent that they project beyond ball equator 52' of valve-closure member 13 maximally by only 150 $\mu$m when valve-closure member 13 engages on valve-seat area 26, 26'. Flow passages 27 which, in each case, have a radially outer passage bottom 54 having, for example, the radius of opening area 48 as an extension thereof, extend between the individual guide sections 51. As elucidated in FIGS. 3 and 4 which are top views of valve-seat body 25, it is useful to provide five guide sections 51 and five flow passages 27 in guide area 31 in an alternating fashion over the circumference. However, designs using different numbers are also conceivable but at least three guide sections 51 should exist at all events. The top view of valve-seat body 25 shown in FIG. 4 is primarily intended to elucidate the places of contact of valve-closure member 13, which is not shown here, in the area of valve seat 26, 26', and at guide sections 51 in valve-seat body 25 respectively, the used blackenings not representing a true-to-scale marking.

Thus, areas 26, 26', 51 of valve-seat body 25 which perform sealing and guiding functions are simultaneously fine-machined with the assistance of the very exactly formed master ball 130. In the application of the ball honing, or precision grinding, or lapping using master ball 130, the immediate sealing surface, which, in the exemplary embodiment shown in FIG. 2, is the slightly raised annular seat area 26', as well as guide sections 51 are exactly adapted to the form of master ball 130, or the minimally smaller valve-closure member 13 respectively. In the process, master ball 130 transfers its curvature to the axially very short guide sections 51, the end result being slightly curved guide sections 51 at the end of guide area 31 facing away from valve-seat area 26. Using the above described machining technology, rotational accuracies are achieved in an advantageous fashion, which cannot be achieved in the case of known ball/conical sealing-seat arrangements with a comparably small outlay. This manufacturing process guarantees nearly ideal roundnesses in valve-seat area 26, having deviations (circularity tolerances) of only 0.5 $\mu$m or less.

What is claimed is:

1. A fuel injector having a longitudinal valve axis, comprising:

a valve needle including at least a spherical valve-closure member and a valve-seat body which has a through opening, the through opening having at least a guide area, a valve-seat area situated in a downstream direction, and at least one of an inlet area and an opening area, the valve-closure member cooperating with the valve-seat area, the guide area having a plurality of guide sections which are interrupted in a circumferential direction by flow passages, the plurality of guide sections, while facing away from the valve-seat area, extending axially to project beyond a ball equator of the valve-closure member by a maximum distance of 150 $\mu$m when the valve-closure member engages on the valve-seat area; and an actuator axially moving the valve needle.

2. The fuel injector according to claim 1, wherein the plurality of guide sections have a slight curvature with a first radius, the first radius substantially corresponding to a second radius of the valve-closure member.

3. A method for manufacturing a valve-seat body, comprising the steps of:

manufacturing the valve-seat body having a cylindrical outside contour, the valve-seat body including a valve seat for a fuel injector;

forming a through opening inside the valve-seat body, the through opening including a guide area, a valve-seat area and at least one of an inlet area and an opening area;

forming the valve-seat area as a frustoconical section of the through opening;

forming the guide area to include web-type guide sections and duct-type flow passages which are arranged in an alternating manner over a circumference of the guide area; and simultaneously fine-machining all of the web-type guide sections and the valve-seat area using a master ball, the master ball functioning as a machining tool.

4. The method according to claim 3, wherein the fine-machining step is performed using a ball honing procedure.

5. The method according to claim 3, wherein the fine-machining step is performed using a precision grinding procedure.

6. The method according to claim 3, wherein the fine-machining step is performed using a lapping procedure.

7. The method according to claim 3, wherein a first diameter of the master ball is slightly greater than a second diameter of a spherical valve-closure member, the spherical valve-closure member cooperating with the valve seat.

8. The method according to claim 3, further comprising the step of:

premolding a raised annular seat area on the frustoconical valve-seat area.

9. The method according to claim 8, wherein a raised portion of the annular seat area is located at a distance of approximately between 50 $\mu$m and 100 $\mu$m from the valve-seat area.

10. The method according to claim 3, further comprising the step of:

transferring a curvature of the master ball to the guide sections to form slightly curved guide sections at an end portion of the guide area, the end portion facing away from the valve-seat area.

* * * * *